United States Patent [19]
Balko et al.
[11] 4,126,535
[45] Nov. 21, 1978

[54] CHLOROTRIFLUOROETHYLENE CONTAINING POLYMER DIAPHRAGM

[75] Inventors: Edward N. Balko, Trenton; Shyam D. Argade, Woodhaven; James E. Shrewsburg, Southgate, all of Mich.

[73] Assignee: BASF Wyandotte Corporation, Wyandotte, Mich.

[21] Appl. No.: 742,818

[22] Filed: Nov. 18, 1976

[51] Int. Cl.² ..... C25B 13/08; C25B 1/46
[52] U.S. Cl. ..... 204/296; 204/98
[58] Field of Search ..... 204/296, 98

[56] References Cited

U.S. PATENT DOCUMENTS

| | | | |
|---|---|---|---|
| 3,356,607 | 12/1967 | Eisenmann et al. | 204/301 |
| 3,450,623 | 6/1969 | Joo et al. | 204/256 |
| 3,694,281 | 9/1972 | Ledul | 204/295 X |
| 3,928,166 | 12/1975 | O'Leary et al. | 204/282 |
| 3,945,910 | 3/1976 | DeCeuster et al. | 204/296 |
| 4,026,783 | 5/1977 | Grot | 204/266 |
| 4,036,729 | 7/1977 | Patil et al. | 204/296 |

FOREIGN PATENT DOCUMENTS

| | | | |
|---|---|---|---|
| 795,724 | 8/1973 | Belgium | 204/296 |

*Primary Examiner*—F.C. Edmundson
*Attorney, Agent, or Firm*—John W. Linkhauer; Bernhard R. Swick; Robert E. Dunn

[57] ABSTRACT

Fibers about micron size in cross-section of certain fluorine-containing polymers can be treated after being deposited as a diaphragm, either during operation or separately before installation, so that they develop a 0.25-millimeter-thick ply on either side of a central body which is substantially different in chemical composition. This yields a diaphragm 1 to 5 millimeters thick which has a Mullen burst strength approximately three to five times greater than that of an untreated diaphragm (20–25 pounds per square inch versus 5 to 7 pounds per square inch) and a remarkably improved service life in the treated diaphragm (200 days and up) in comparison with such untreated diaphragm (30 days or less). Use of a polymer based upon a major proportion of chlorotrifluoroethylene appears to be required. This discovery is economically significant, in that it is an essential element in the technology of the replacement of asbestos diaphragms now used with a synthetic material. Health-hazard and pollution-control considerations have made it desirable to replace asbestos, and this invention provides the key to the solution of the problem. Moreover, a synthetic-polymer diaphragm has two significant advantages that an asbestos one lacks—it will withstand washing or cleaning with an acid solution, and it does not swell in service and resists erosion, so that a closer electrode spacing can be used and the cell voltage can thus be lower.

9 Claims, No Drawings

CHLOROTRIFLUOROETHYLENE CONTAINING POLYMER DIAPHRAGM

BACKGROUND OF THE INVENTION

1. Field of the Invention

This invention relates to the electrolysis of alkali-metal halides, and in particular, it relates to the making of diaphragms intended to replace asbestos in cells for such use. Still more particularly, it relates to a process in which the diaphragms are made of synthetic fiber material rather than asbestos, and the diaphragms exhibit not only satisfactory short-term performance characteristics but also satisfactory service life.

2. Description of the Prior Art

The making of diaphragms for brine-electrolysis cells from asbestos has been widely practiced throughout the world for many decades. Those skilled in the art are familiar with the techniques involved, which include suspending the asbestos in water, brine, or weak cell liquor (aqueous sodium hydroxide) to form a slurry, and then, by drawing a vacuum upon the interior of a cathode screen box and immersed in the slurry, causing the diaphragm to be deposited on the exterior of the cathode screen or mesh, which is then mounted within the cell and put into service. The techniques for making diaphragms of this kind which yield satisfactory performance characteristics (such as a tolerably low cell voltage at a current density sufficiently high, a desirably low chlorate content in the caustic product, a satisfactory current efficiency, and good service life) are well known to those skilled in the art. Now that the brine-electrolysis industry has adopted dimensionally stable anodes, it is necessary for the diaphragm material to give a service life on the order of several hundred days if it is not to become a limiting factor with respect to how long a cell can be operated between renewals. Asbestos meets these requirements, but most of the materials which have heretofore been tried as a replacement for asbestos have failed in some respect. Either the performance characteristics are poor, or they are adequate, but they can be maintained only for a relatively short service life, such as 1 month or less.

Moreover, the desirability of finding a material to replace asbestos has become increasingly apparent in recent years. The mining and handling of asbestos presents a health hazard to the workers dealing with it, and this health hazard can be overcome only by adopting measures to protect the involved personnel which add very considerably to the cost of producing and using the asbestos. Not only from the standpoint of the hazard to the personnel involved, but also from the consideration that the spent asbestos diaphragms must be disposed of (and this creates a pollution problem), the widespread use of asbestos is becoming increasingly regarded as intolerable.

The problems confronting one, however, in arriving at an adequate substitute technology, are formidable.

In the first place, it is not easy to obtain a synthetic substance in a physical form that will approximate the performance of fibers of asbestos. Most of the techniques known hitherto have produced fibers that are relatively too coarse, such as tens or dozens of microns in diameter or similar dimension, where what is needed in order to obtain the permeability desired in the product diaphragm is a fiber much finer, on the order of 1 micron by 4 microns in cross-section or less. The idea that such fibers, made of plastic materials which are "self-bonding" in the sense that these materials will coalesce when heated to a proper temperature and thus afford a diaphragm useful in a chloralkali cell is one which appears in the copending U.S. application Ser. No. 548,684, filed Feb. 10, 1975.

Moreover, the environment in which the synthetic fibrous material must operate is a hostile one. On one side of the diaphragm, there is a hot caustic solution with a temperature of about 90° C. and a pH of 14 or greater. On the other side of the diaphragm is the brine solution, which is also hot but may be, on the contrary, acidic, with a pH of about 2 to 4. During operation, there is a considerable evolution of gas taking place on both sides of the diaphragm, so that the solutions in contact with the diaphragm are also turbulent. It is not simple to find materials of the strength and chemical inertness required to suit them for use in such a hostile environment.

There has been, moreover, another problem. The materials which seem most promising, in terms of strength and chemical inertness, are fluorinated polymers, but they exhibit the concomitant drawback that they are relatively hydrophobic. In contrast, asbestos may be characterized as being hydrophilic. The difficult wettability of the fluorinated polymers is troublesome in that it is difficult to start and maintain a proper flow of liquid through the diaphragm if the diaphragm is difficult to wet. If the diaphragm dewets before (or after) the cell is started, reasonable flow cannot be established through the diaphragm, and the cell is not practically workable. During operation, partial or total dewetting has a similar bad effect. Accordingly, even if a material of suitable chemical resistance and physical strength is found and produced in a sufficiently divided physical form, other problems indicated above must be solved before a technology to replace the existing practice of making diaphragms from asbestos will be available.

In the state of the art, it is obvious from U.S. Pat. No. 3,971,706, that, even working with fibers of polytetrafluoroethylene that are tens or dozens of microns in minimum dimension, and using, if necessary, a slurry-forming technique which requires constant use of a stirrer, it is possible to produce a diaphragm and cause it to operate in a cell which is supplied with brine and which produces chlorine and caustic. The above-mentioned patent teaches one way of dealing with a dewetting problem in a diaphragm-type chlor-alkali cell which has a diaphragm of relatively hydrophobic material, such as polytetrafluoroethylene. Nevertheless, that patent is not to be understood as implying that the diaphragms made with it would at all necessarily give satisfactory service life and good performance characteristics in the commercial production of chlorine and caustic.

The prior art also contains the copending application of Arvind S. Patil and Shyam D. Argade, Ser. No. 548,684, filed Feb. 10, 1975, titled "Thermoplastic Fibers as Separator or Diaphragm in Electrochemical Cells". This application discloses and claims the use of fluorohydrocarbons and other self-bonding thermoplastic materials as diaphragms in electrochemical cells. The application specifically mentions various kinds of fluorine-containing polymer for such purpose, the fibers having a dimension of between 0.05 and 40 microns. It is noteworthy, moreover, that this patent application speaks about "self-bonding" and defines the term in such a way that the diaphragm produced must be heat-treated before being used. Moreover, the patent application does not indicate how long its good performance characteristics could be maintained, and it does not give any basis for selecting, among the various polymers which it mentions, the ones that are suitable for use in accordance with the present invention. The patent application goes on to teach that because of the hydrophobic nature of the thermoplastic fibers, it is necessary to include within the internal structure or matrix of the fibers per se a hydrophilic material to ensure the wetting ability of the fibers, and that the wetting agent used may be of organic or inorganic nature, including the oxyalkylene condensates of ethylene diamine and other polyol surfactants, asbestos, barium titanate, titanium dioxide, or (apparently in solid form) a fluorine-containing commercially available surfactant, such as FLUORAD "FC-126" or "FC-170". It is worth noting that, even with the availability of the above-indicated concepts, which are related to those employed in accordance with the present invention, there was not obtained a technologically satisfactory result, partly because of the failure to select a proper polymer and to put it into a proper physical form before making the diaphragms, but largely because of a failure to grasp the present invention.

Attention is also to be paid to Application Ser. No. 566,911, in the names of Arvind S. Patil and Eugene Y. Weissman, titled "Diaphragms from Discrete Thermoplastic Fibers Requiring No Bonding or Cementing", and filed on Apr. 10, 1975, now U.S. Pat. No. 4,036,729. This patent teaches that even without the heat treatment, various thermoplastic materials which have been put into fibrous form in accordance with a method described in Belgian Pat. No. 795,724, can be made into diaphragms for electrochemical cells. This patent teaches that polychlorotrifluoroethylene is among the materials capable of being so treated, but at the time that that application was filed, polychlorotrifluoroethylene was mentioned only because it was chemically similar to various polymers which had been tried and found in bench-scale tests of relatively short duration to yield satisfactory short-term performance characteristics. Again, it is not to be taken from this application that the problem of providing a satisfactory technology providing a material to replace asbestos for the formation of diaphragms in the electrolysis of brine, had been achieved, as it has been with this invention. It was not, for example, appreciated that there might exist, as there do, certain polymers, such as those based upon polychlorotrifluoroethylene, which exhibit the peculiar property, when placed into an environment of chlorine-cell anolyte or catholyte solution at about 80° to 90° C. for a period on the order of 2 weeks, of developing a pair of surface layers or plies, because of the transformation of certain surface portions of the individual fibers involved into a material of substantially different composition, and that this yields a diaphragm of very substantially increased burst strength and service life.

SUMMARY OF THE INVENTION

Diaphragms composed in major or important part of the fibers of synthetic material and being substantially or totally free of any content of asbestos, while yet exhibiting not only satisfactory performance characteristics but also good service life can be produced by a method which involves (a) taking an appropriate fluorinated polymer; (b) putting it in the form of very fine fibers, by a method involving dissolving it in a solvent such as tetrahydrofuran which is miscible with water although the polymer is not, and leading the polymer-solvent mixture through a nozzle under conditions of high shear into a body of water to cause the polymer to be formed into fibers of very small dimension, such as about 0.01 to 40 microns; (c) making a slurry of the polymer fiber solution in water, with the aid of a surfactant; and then (d) using the slurry so produced to deposit a diaphragm upon a cathode of a diaphragm-type electrolytic cell for the electrolysis of brine. When this is done, and the cell is placed into service, there develops through a period of approximately 2 weeks a pair of surface plies on the cell-deposited diaphragm which are separable from the main body of the deposited diaphragm, and they exhibit, when tested, a lower molecular weight when determined by the intrinsic viscosity method[1] (70,000 to 150,000 versus 180,000 to 250,000 for the main body of the polymer). Moreover, the burst strength of the diaphragm changes, going from an initial value of perhaps 5 to 7 pounds per square inch to an increased value of 20 to 25 pounds per square inch, and as a result of the development of such surface plies, the service life of the diaphragms is accordingly increased, from a value initially on the order of 30 days or less to a higher value, such as 200 days or more. The tenacious character of the modified surface plies imparts a substantial erosion resistance to the fiber web. This development constitutes a substantial and significant advance, making it possible to replace existing asbestos-diaphragm technology with an alternative technology in which the use of asbestos is very greatly diminished, if not eliminated entirely. Thus, while continuing to obtain satisfactory performance characteristics such as high caustic concentration and low chlorate levels in the weak-cell-liquor product, and at the same time maintaining adequate service life, there is produced in accordance with the invention a diaphragm which also has capabilities which an asbestos diaphragm does not: it will withstand an acid wash, using, for example, 1:1 water:hydrochloric acid, even if such wash is continued beyond the time that the impurities that it was intended to remove have been caused to disappear; and the diaphragm will in some cases make it feasible to produce a caustic soda product which is of higher concentration than would, other things being equal, be obtained.

[1] Eugene K. Walsh and Herman S. Kaufman, "Intrinsic Viscosity—Molecular Weight Relationship for Polychlorotrifluororoethylene," paper presented at American Chemical Society Fluorine Symposium, September 1956.

If the cell is run at higher temperature and pressure, formation of the desired plies can be accelerated.

DESCRIPTION OF THE PREFERRED EMBODIMENTS

There will be described the best mode contemplated by the inventors of practicing their invention, and thereafter, there will be discussed the various modifications and equivalents which may be practiced.

With respect to the chemical content of the fibers to be used, there is selected a composition based upon a copolymer of, on the average, 24 molecular units of chlorotrifluoroethylene and 1 molecular unit of vinylidene fluoride. Such material is commercially available from Allied Chemical Company under the name "Aclon 2100". Also suitable is the homopolymer of chlorotrifluoroethylene sold by 3M Company as "Kel-F 81".

Such material is put into the form of fibers having a cross-section on the order of 1 micron by 4 microns and a length of approximately 0.25 to 0.5 millimeters in $\eta$ = the viscosity of the permeating fluid, in units of poise;

$\Delta P$ = the pressure differential driving the fluid through the diaphragm, in units of atmospheres; and $L$ = the thickness of the diaphragm, in centimeters.

[2] P. C. Carman: "*Flow of Gases Through Porous Media*", Butterworth's, London (1956), Chapter 1.

Double-layered diaphragms prepared by the method described above will typically have a permeability coefficient in the range of $0.5 \times 10^{-9}$ square centimeters to $3 \times 10^{-9}$ square centimeters. Diaphragms thus prepared equal or surpass the separator performance of deposited asbestos diaphragms and operate at a reduced cell voltage, thus increasing the overall energy efficiency of brine electrolysis.

The permeability of a deposited asbestos diaphragm is typically one to two orders of magnitude smaller than that of the diaphragms comprising this invention. The higher permeability of the synthetic diaphragms, at no penalty in separator performance, provides still another substantial benefit.

An important aspect of a piece of manufacturing equipment is its space-time yield. Conventional monopolar chlorine cells and filter-press diaphragm cells are designed, in part, to be compatible with the flow characteristics of asbestos diaphragms. Accordingly, an appreciable fraction of the anolyte compartment must be devoted to "head space", that is, a space where a liquid head of brine is maintained to provide the driving force which causes electrolyte to percolate through the diaphragm. This section of the cell body does not actively participate in electrolysis.

The diaphragms of this invention have a much lower "head space" requirement than asbestos and, accordingly, more of the cell body may be devoted to electrolysis, rather than serving as a reservoir. This means that it is possible, using the technology of the present invention to design a cell which is relatively more compact, for a given production rate, than a chlor-alkali cell designed according to the prior art and using existing technology.

In accordance with the invention, the cell should be operated, if it contains the diaphragms in accordance with the present invention, at a temperature in the range of 80° to 90° Celsius. This is approximately 10° lower than the temperature ordinarily used when diaphragms of asbestos are employed. The diaphragms of this invention perform equally well at lower temperatures, but with the well-known increase in solution resistance with decreasing temperature, a voltage penalty will be exacted at the lower temperatures.

Operation above 90° C. is undesirable as it has been found to lead to delamination of the surface plies, and loss of the benefits they impart, if continued for more than a few hours.

The diaphragms of this invention have no unusual disposal problems when they are at the end of their useful service life. In marked contrast with asbestos, which is so stable at elevated temperatures that it is widely used as an insulator, the fibers which form the diaphragms of this invention may be cleanly destroyed by a mild thermal treatment which will cause them to fuse and hence lose identity as discrete particles, or by a vigorous thermal treatment which will lead to their incineration.

There will now be discussed the possible modifications and equivalents.

With respect to the polymer to be selected, as discussed above, the homopolymer of chlorotrifluoroethylene may also be used, as we have done work with the material commercially available under the trademark "Kel-F81". Those skilled in the art will appreciate that other chlorotrifluoroethylene polymers can be used, especially those which contain at least 80% of chlorotrifluoroethylene units and up to 20% of units of other compatible $C_2$ to $C_4$ unsaturated monomers, especially fluorine-containing $C_2$ or $C_3$ unsaturated monomers.

The precise conditions to be used in the making of the micron-sized fibers may be varied to suit the requirements. If fibers of smaller cross-section can be made, by using (for example) a smaller orifice in the process of Belgian Pat. No. 795,724, a diaphragm of lower permeability can be obtained, and this will make it easier to obtain a product liquor of higher sodium hydroxide content. On the other hand, if there is used some other method to make the finely divided fibers used to form the diaphragm, and as a result, the diameter in cross-section of the fibers thus produced is somewhat greater, the permeability of the diaphragm may be expected to be somewhat greater, and as has been indicated above, this means that the head which is required to obtain a given flow through the diaphragm will be correspondingly lower, and it also means that the sodium hydroxide content in the weak-cell liquor produced can be expected to be correspondingly lower. Insofar as the concept of the present invention is concerned, however, the cross-sectional dimension or dimensions of the fibers used in accordance with the present invention may be varied in a way which will be apparent to those of ordinary skill in the art. The dimensions of the fibers are not as important as the overall permeability of the diaphragm made from them.

One is not restricted to fiber of a single size in making the diaphragms of the present invention. Blends or mixtures of two or more different fiber sizes are also suitable.

In general, it may be stated that the synthetic fibers made in accordance with the present invention have a cross-sectional dimension on the order of 0.05 to 10 microns.

Various alternatives suggest themselves to those skilled in the art in regard to the forming of the composition used to make the diaphragm. Other surfactants than the "FLUORAD FC-170" mentioned above may, of course, be used, a principal consideration being the desirability of reducing the surface tension of the medium to below 30 dynes per centimeter. Means other than air sparging can, of course, be used to ensure the agitation of the composition during the vacuum deposition of the diaphragm, and in the case of diaphragms of relatively small dimension, such agitation may be omitted entirely after the initial dispersion of the fibers to form a slurry because the diaphragm may be formed before the composition has an adequate opportunity to separate to an appreciable extent.

Those skilled in the art will vary the schedule of the degree of vacuum and the time used therefore in accordance with the permeability requirements of the diaphragm. When the fibers are of different dimensions or where blends of different sized fibers are used, either the deposition time or the degree of vacuum drawn on the interior of the cathode member may be changed from that specified above in order to produce a diaphragm having given permeability characteristics.

accordance with a modification of a process which is adequately described in Belgian Pat. No. 795,724. The surface area of such fibers is 5 to 20 square meters per gram as measured by nitrogen adsorption. There is thus produced a material which is, in effect, water-soaked fiber bundles, containing 80 to 90 percent by weight water, made by draining the output of the process conducted according to the above-mentioned Belgian patent on a perforated moving bed.

Such material is mixed with other material to form a composition of matter suitable for the manufacture of a synthetic-fiber diaphragm made in accordance with the present invention.

Such a composition of matter, in accordance with a best mode of practicing the present invention, consists essentially of about 12 or 13 grams per liter of fibers of the kind of polymer indicated above, and about 2 grams per liter of a fluorine-containing surfactant dissolved in water such as the surfactant sold by 3M Company under the name FLUORAD "FC-170" (which is a proprietary mixture of fluorinated alkyl polyoxyethylene alcohols containing 38.3% carbon, 31.3% fluorine, and 5.3% hydrogen by weight).

An alternative surfactant system is a mixture of FLUORAD "FC-170" with a conventional surfactant, sodium dioctyl sulfosuccinate; the dispersion liquid contains 2 grams per liter of the fluorocarbon surfactant and 8 grams per liter of the conventional surfactant, the balance being water, or an equivolume mixture of water and acetone. It is possible to take as-received water-containing fibers, conduct a water-content determination, and then make a composition of matter as defined above.

A composition of the kind defined above will, if nothing is done, settle out in some short period of time, such as approximately 5 minutes. Accordingly, in the use of such composition for the formation of diaphragms, it is ordinarily desirable to maintain a composition in suspension by providing a sparging with air, and a rate such as 3 to 10 standard cubic feet per minute per square foot cross-sectional area (0.091 to 0.3047 standard liters per minute per square centimeter).

Alternative methods for dispersion of the diaphragm-forming fibers in the aqueous phase are the use of a propellor-type agitator or a recirculating pump system in place of the air sparging system.

The next step is the making of a diaphragm by immersing a cathode member in the composition indicated above and drawing upon the interior of the cathode a suitable vacuum.

In accordance with a best mode of practicing the invention, this is done by adopting a practice in which, after the cathode member is immersed in the composition of matter described above, there is drawn upon its interior first a mild vacuum such as 25 millimeters of mercury less than atmospheric pressure, for a period of 2 minutes, and then a somewhat increased degree of vacuum, such as 50 millimeters of mercury, for a further period of 3 minutes. Then considering that by this point a considerable thickness of diaphragm has been deposited upon the cathode member, it becomes possible to apply "full vacuum", so that the interior of the cathode member is now, for 20 minutes, subjected to the action of a vacuum which is capable of being as great as 710 millimeters of mercury below atmospheric pressure, i.e., an absolute pressure of approximately 50 millimeters of mercury, though a value that extreme is seldom achieved in actual practice. Usually, in the final "full vacuum" stage, the absolute pressure reached in the making of the diaphragm by subjecting the interior of the cathode member to vacuum does not come to more than about 685 or 690 millimeters of mercury below atmospheric pressure.

While it is possible to form a useful diaphragm by employing a single deposition sequence, the best mode of practicing the present invention employs two layers, the second deposited atop that which is deposited directly on the cathode screen.

A double-layered diaphragm is produced by drawing the above-described slurry through the cathode screen at a ratio of 8 to 10 cubic centimeters of slurry per square centimeter of screen area. This is done by applying a 25 millimeters of mercury vacuum for 2 minutes; 50 millimeters of mercury vacuum for 3 minutes; then 100 millimeters of vacuum for 3 minutes. At this point the vacuum is returned to 25 millimeters and a second volume of slurry is drawn through the screen. The best mode of practicing this invention is to employ a volume of slurry essentially equal to that used to form the first layer, namely 8 to 10 cubic centimeters per square centimeter of screen area.

The same vacuum sequence is then followed. After the vacuum has been maintained at 100 millimeters of mercury for 3 minutes, "full vacuum" is applied for 20 minutes.

While it is indeed possible to produce a useful diaphragm consisting of a single layer, the double-layer deposition sequence offers the advantage that the deposition of the second layer acts to correct flaws or defects in the primary web, producing a more uniform and homogeneous structure.

This operation produces upon the cathode member a diaphragm which has a gross thickness on the order of 1 to 5 millimeters, more usually 2 to 3 millimeters, a typical value being 2.5 millimeters, or about 0.1 inch.

The next step is to subject the diaphragm, deposited upon its cathode, to drying. We use an oven at 110° C. for a period of several hours, such as 8 hours.

By now, there has been produced on the cathode member a diaphragm web which is cohesive and suitable for measurement of permeability. In order to be certain that the web is a suitable structure for the intended use, it is subjected to a permeability measurement at 25° C. using pure nitrogen gas as the permeating fluid and because, in our experience, the relative coarseness or fineness of the screen which comprises the undiaphragmed cathode member exerts an important influence upon the number which is obtained when a test of this kind is conducted, it is necessary to indicate that the numbers herein are based upon a cathode screen which has ten wires by nine wires per a 4-centimeter square. These wires are 2 millimeters in diameter. Under such conditions, one obtains values for the permeability coefficient of the diaphragm on the order of 0.5 to $3.0 \times 10^{-9}$ square centimeters as a permeability coefficient where the permeability coefficient is defined by [2]:

$$B_o = -(\mu \eta L/\Delta P)$$

where $B_o$ = the c.g.s. permeability coefficient in units of square centimeters;

$\mu$ = the volumetric flow rate through the diaphragm, in units of centimeters per second;

In regard to how the diaphragm is to be used, after it has been installed, those skilled in the art will again find modifications or variations to make, but these will, in most cases, be dependent upon the degree of permeability which has been achieved.

Although there has been described above the process of making a diaphragm containing the particular kinds of surface plies which give it its desirable characteristics in a manner of having the diaphragm deposited and in service in an operating cell, those skilled in the art will appreciate that it is entirely possible to produce such surface plies upon a diaphragm deposited upon a cathode member in another way, namely, the subjecting of such a diagram-coated cathode member, outside the cell, to an environment approximating, at least in effect, that which does, in the cell, yield the kind of result in which we are interested. Thus, it is possible, after the diaphragm is deposited upon the cathode member and before it is dried at 110° C. for several hours to proceed with the generation of such surface layers by immersing the diaphragm in the hot (75° to 90° C.) caustic, 120–140 grams per liter, it being usual to include also 0.2–1.0 grams per liter of sodium hypochlorite or the like, for a period of 2 weeks. Those skilled in the art will also appreciate that it will be possible to shorten the time by using a superatmospheric pressure and a higher temperature, such as 120° C., but they will also appreciate that it is difficult to move in this direction, because of the heat-sensitiveness of the polychlorotrifluoroethylene polymer employed.

Those skilled in the art will also appreciate that it will be possible to use mixtures of polychlorotrifluoroethylene homopolymer with the above-mentioned copolymer, or even with a small proportion of a fiber that would, by itself, be unsatisfactory, such as a smooth polytetrafluoroethylene. It is not possible to state a simple upper limit for the proportion of fiber of other composition which may be so employed, for the most important factor is the permeability of the diaphragm which is to be produced, and this will to a great extent be dependent upon other factors, such as the dimensions of the fibers used to form the mixture.

Our work shows that the thickness of the plies formed on diaphragms according to the invention does not, with prolonged operation, increase.

Where setting difficulties are experienced during the initial operation of the diaphragms of this invention, it is useful to add a small quantity of surfactant, such as the "FLUORAD FC-170" mentioned above, to the anolyte chamber in order to initiate flow. The application of a gentle vacuum to the catholyte compartment is also beneficial in this regard. Once wetted and flowing, the diaphragms of this invention have never been observed to dewet.

The invention is further illustrated by the following specific examples, which are to be taken as illustrative and not in a limiting sense.

EXAMPLE 1

There was operated a cell, having a diaphragm made in accordance with the present invention, said cell being identified in our records as "6182 S". The composition of the diaphragm was "Aclon 2100" polymer. The average cross-sectional dimensions of the fibers used to form the diaphragm were 1 micron by 4 microns, with a length of 0.25 to 0.5 millimeters. Such fibers were suspended in water, to the extent of 12.7 grams per liter (dry weight of fiber employed), along with 4 grams per liter of dioctyl sodium sulfosuccinate and 2 grams per liter of a fluorine-containing surfactant, namely, that sold by 3M Company under the designation FLUORAD "FC-170".

Fiber dispersion and slurry agitation were performed with the use of a propellor-type mechanical agitator driven by a "Lightnin" mixer.

A two-layered web was formed by drawing two successive volumes of slurry through the cathode screen at a ratio of 8.3 milliliters of slurry per square centimeter of screen area per layer according to the following schedule: 2 minutes at 25 millimeters of mercury difference from atmospheric pressure, 3 minutes further at 50 millimeters of mercury difference in pressure, and 2 minutes further at 100 millimeters of mercury difference in pressure.

The second layer was then applied: 3 minutes at 50 millimeters of mercury difference from atmospheric pressure, 8 minutes further at 100 millimeters of mercury difference in pressure, and 2 minutes further at 150 millimeters of mercury difference in pressure. The full vacuum of 615 millimeters of mercury was then applied for 20 minutes. There was obtained a diaphragm having a gross thickness of 2.7 millimeters and having a permeability coefficient $1.7\times10^{-9}$ square centimeters. After being dried at 110° C. for 16 hours, such diaphragm was installed in a cell with a 6.4 millimeter electrode gap. The anode was of the "DSA" type. The cathode was mild steel.

The following performance data were measured at a current density of 160 milliamperes per square centimeter.

| Day of Operation | Cell Temperature | Cell Voltage | Sodium Hydroxide Concentration | Sodium Chlorate Concentration |
|---|---|---|---|---|
| 13 | 70° C | 3.31 | 116 gpl. | <0.1 gpl. |
| 40 | 73° | 3.18 | 124 | 0.10 |
| 63 | 78° | 3.21 | 120 | 0.12 |
| 105 | 62° | — | 120 | 0.1 |

EXAMPLE 2

A diaphragm identified in our records as "6182 G" was prepared by the method described in Example 1.

The diaphragm was 2.6 millimeters in thickness and had a permeability coefficient of $2.0\times10^{-9}$ square centimeters.

The following data were recorded:

| Day of Operation | Cell Temp., ° C | Cell Voltage | NaOH Conc. g./l. | $NaClO_3$ Conc. g./l. |
|---|---|---|---|---|
| 22 | 76 | 3.29 | 123 | 0.25 |
| 32 | 73 | 3.28 | 131 | 0.21 |
| 34 | 65 | 3.41 | 140 | 0.31 |
| 67 | 77 | 3.28 | 143 | 0.45 |

EXAMPLE 3

A two-layered diaphragm identified in our records as "6142 IQ" was prepared from "Aclon 2100" fiber by essentially the same method described in the previous example, with the exception that 8.3 milliliters of slurry per square centimeter of screen area were used for the first layer and 4.1 milliliters per square centimeters were used for the second.

On the 16th day of operation, this diaphragm produced 86 grams per liter NaOH at 0.12 grams per liter $NaClO_3$. On the 277th day of operation, the diaphragm performance was unchanged, namely, 86 grams per liter NaOH at 0.2 grams per liter $NaClO_3$.

EXAMPLE 4

A single-layered diaphragm identified in our records as "6142 NM" of "Aclon 2100" polymer was prepared as follows. Fibers were dispersed with a mechanical agitator in the following concentrations:

12 grams per liter of "Aclon" fiber, 9.5 grams per liter sodium dioctylsulfosuccinte, and 2 grams per liter "FLUORAD FC-170".

The solvent was an equivolume mixture of water and acetone.

The deposition sequence followed was to draw 12.5 milliliters per square centimeter of slurry according to the schedule:

| Time, Min. | Vacuum, mm. Hg |
|---|---|
| 2 | 25 |
| 2 | 50 |
| 2 | 100 |
| 2 | 150 |
| 2 | 200 |
| 15 | 370 |

The diaphragm was dried at 110° C. for 16 hours. It was 2.6 millimeters in thickness and had a permeability coefficient of $1.5\times10^{-9}$ square centimeters. The following data were obtained in a cell similar to that described above and operated at 160 milliamperes per square centimeter.

| Cell Temp., ° C | Cell Voltage | NaOH Conc., g./l. | $NaClO_3$ Conc., g./l. |
|---|---|---|---|
| 80 | 3.37 | 109 | 0.10 |
| 79 | 3.37 | 123 | 0.05 |
| 78 | 3.25 | 140 | 0.15 |
| 78 | 3.34 | 154 | 0.24 |

EXAMPLE 5

There was operated a cell having a diaphragm made in accordance with the present invention, said cell being identified in our records as "6142 KX". The composition of the diaphragm was "Kel-F 81" polymer. The average cross-sectional dimensions of the fibers used to form the diaphragm were 1 micron by 4 microns, with a length of 0.25 to 0.5 millimeters. Such fibers were suspended in water, to the extent of 13 grams per liter (dry weight of fiber employed), along with 9 grams per liter of dioctyl sodium sulfosuccinate and 4 grams per liter of a fluorine-containing surfactant, namely, that sold by 3M Company under the designation "FLUORAD FC-170". Fiber dispersion and slurry agitation were again by a mechanical agitator.

A two-layer web was formed by a sequence essentially the same as described in Example 1. This diaphragm was 4.5 millimeters in thickness and had a permeability coefficient of $3.0\times10^{-9}$ square centimeters.

The diaphragm was installed in a cell similar to that described above and operated at 160 milliamperes per square centimeter. After 15 days of operation, the cell voltage was 3.33 volts at 76° C. with a sodium hydroxide concentration of 120 grams per liter and 0.25 grams per liter $NaClO_3$. On the 35th day of operation, the cell voltage was 3.41 volts at 83° C. with 105 grams per liter NaOH and 0.15 grams per liter $NaClO_3$.

COMPARISON TEST

For comparative purposes, diaphragms have been prepared from fiber of the same dimensions as those of the "Aclon 2100" fiber but made from the 1:1 copolymer of chlorotrifluoroethylene and ethylene. This material is available from the Allied Chemical Company under the name "Halar 5004". In operation as a chlor-alkali cell separator, the "Halar" polymer does not form the surface plies which confer the desirable properties on diaphragms of "Aclon 2100" and "Kel-F 81" fluoropolymers.

One such diaphragm, known in our records as "6091 D", a two-layered web, was prepared by essentially the same procedure described in any of the first three examples. The diaphragm was installed in a chlor-alkali cell and operated at 160 milliamperes per square centimeter, 80°-85° C., and at a 6.4-millimeter electrode spacing. After 7 days of operation the diaphragm had failed completely. Inspection revealed that the electrolyte turbulence within the cell had so severely eroded the deposited "Halar" web that no diaphragm remained on most of the cathode screen.

Molecular-weight determinations were made on the remaining polymer from several failed "Halar" diaphragms. The molecular-weight determination was made by gel-permeation chromatography in orthodichlorobenzene at 160° C. There was little, if any, polymer degradation. Diaphragm failure was due to hydraulic effects.

EXAMPLE 6

A diaphragm identified in our records as "6159 OS" was prepared from a fiber blend.

The fiber slurry was prepared from 12.3 grams per liter "Aclon 2100" fiber of the type described above; 2.5 grams per liter smooth polytetrafluoroethylene fiber of approximately 30 microns by 60 microns in cross-section and a length of 20 millimeters; 2 grams per liter "FLUORAD FC-170"; 2 grams per liter sodium dioctylsulfosuccinate; and the remainder being a 1:1 mixture by volume of water and acetone.

A two-layered diaphragm was prepared from this fiber mixture, by essentially the same method in Example 1.

The diaphragm was installed in a test cell under the conditions described above. On the 28th day of operation the cell operated at 3.61 volts at 79° C. with 100 grams per liter sodium hydroxide and less than 0.10 grams per liter sodium chlorate. On the 110th day of operation, the cell voltage was 3.68 volts at 77° C. with 94 grams per liter sodium hydroxide and 0.45 grams per liter sodium chlorate.

All attempts to produce a diaphragm from the polytetrafluoroethylene fiber alone by this method were unsuccessful. There was such little entanglement between fibers that the web would not adhere to the cathode screen.

EXAMPLE 7

Mullen burst-strength measurements, a form of tensile-strength determination, were made on a number of diaphragms, including diaphragms as deposited and those which had seen at least 15 days of service in a chlor-alkali cell.

The measurement was made in a manner similar to that described as ASTM Method D774-61, paragraphs 1 through 5. Triplicate measurements were made.

It was, of course, necessary to remove the diaphragms from their cathode screens in order to make the measurements.

Results of the measurements were as follows:

| UNUSED DIAPHRAGMS | | |
|---|---|---|
| Diaphragm No. | Diaphragm Thickness, mm. | Mullen Burst Pressure, Pounds/Sq.In. |
| 6146-1 | 2.5 | 5.6 |
| 6146-15 | 3.0 | 7.6 |
| 6146-17 | 3.7 | 7.7 |
| 6146-3 | 4.2 | 6.3 |
| DIAPHRAGMS AFTER AT LEAST 15 DAYS CELL EXPOSURE | | |
| Diaphragm No. | Diaphragm Thickness, mm. | Mullen Burst Pressure, Pounds/Sq.In. |
| 6146-18 | 2.3 | 42.1 |
| 6142-CC | 2.5 | 21.8 |
| 6146-12 | 3.2 | 23.7 |
| 6146-19 | — | 24.7 |

One pound per square inch equals 0.0703 kilograms per square centimeter.

Although there have been shown and described herein certain embodiments of the invention, it is intended that there be covered as well any change or modification therein which may be made without departing from the spirit and scope of the invention.

The embodiments of the invention for which an exclusive property or privilege is claimed are defined as follows:

1. A diaphragm for use in a chlor-alkali electrolysis cell, said diaphragm consisting essentially of fibers having a cross-sectional dimension of 0.3 to 5 microns, said fibers being composed of a fluorine-containing addition polymer selected from the group consisting of the homopolymers of chlorotrifluoroethylene and copolymers of chlorotrifluoroethylene with at least one compatible unsaturated $C_2$ to $C_4$ monomer, units of chlorotrifluoroethylene accounting for at least 80 percent of the monomeric units of said copolymer which exhibits the property of developing, while in service in the hostile environment of a chlor-alkali cell, a surface portion of composition different from that of the bulk of said fiber and effective after a period of use of approximately 2 weeks to increase substantially the burst strength and to prolong substantially the service life of said diaphragm in said cell.

2. A diaphragm as defined in claim 1, wherein said addition polymer is a homopolymer of chlorotrifluoroethylene.

3. A diaphragm as defined in claim 1, wherein said addition polymer is a copolymer containing chlorotrifluoroethylene and vinylidene fluoride.

4. A diaphragm as defined in claim 3, wherein said addition polymer is one containing about 1 monomer unit of vinylidene fluoride per 24 units of chlorotrifluoroethylene.

5. A diaphragm as defined in claim 1, said diaphragm having been produced by a method involving the deposition of first and second layers, whereby the deposition of the second layer acts to correct flaws or defects in the first layer and produce a more nearly uniform and homogeneous structure.

6. A polychlorotrifluoroethylene diaphragm made of fibers about micron-sized in cross-section and having exterior plies lower in molecular weight than the bulk of said diaphragm but substantially increased burst strength and service life, said diaphragm being produced by exposure of said diaphragm to hot caustic solution for a time and at a temperature sufficient to produce said layers.

7. The method of making a diaphragm according to claim 6, wherein said exposure is done by subjecting the diaphragm to cell operating conditions for a period of about 2 weeks.

8. The method of making a diaphragm according to claim 6, wherein said exposure is done by subjecting the diaphragm to hot caustic under superatmospheric conditions outside the cell before inserting it.

9. The method of making a diaphragm according to claim 6, wherein said exposure is done by subjecting the diaphragm to cell operating conditions which are superatmospheric in pressure at correspondingly higher temperature to shorten the period of "in situ" formation of the plies.

* * * * *